US007870961B2

(12) United States Patent
Shai

(10) Patent No.: US 7,870,961 B2
(45) Date of Patent: Jan. 18, 2011

(54) PRODUCT DELIVERY SYSTEM FOR FOODSTUFFS

(76) Inventor: Moti Shai, 3524 Viadel Prado, Calabasas, CA (US) 91302

( * ) Notice: Subject to any disclaimer, the term of this patent is extended or adjusted under 35 U.S.C. 154(b) by 1003 days.

(21) Appl. No.: 11/370,067

(22) Filed: Mar. 8, 2006

(65) Prior Publication Data

US 2006/0191937 A1 Aug. 31, 2006

Related U.S. Application Data

(63) Continuation-in-part of application No. 10/794,597, filed on Mar. 8, 2004, now abandoned.

(51) Int. Cl.

| | |
|---|---|
| ***B65D 85/00*** | (2006.01) |
| ***B65D 30/00*** | (2006.01) |
| ***B65D 33/16*** | (2006.01) |
| ***B65D 81/32*** | (2006.01) |

(52) U.S. Cl. ..... 206/525; 383/2; 383/61.1; 383/81; 426/115

(58) Field of Classification Search ..... 206/525, 206/806; 383/2, 61.1–61.5, 79, 81; 426/112–115
See application file for complete search history.

(56) References Cited

U.S. PATENT DOCUMENTS

| | | | | |
|---|---|---|---|---|
| 3,594,177 | A * | 7/1971 | McGowan | 426/112 |
| 4,148,347 | A * | 4/1979 | Seaman | 383/2 |
| 4,241,865 | A * | 12/1980 | Ferrell | 383/81 |
| 4,902,140 | A * | 2/1990 | Branson | 383/79 |
| 5,035,517 | A * | 7/1991 | Edelman | 383/61.5 |
| 6,139,187 | A * | 10/2000 | Galomb et al. | 383/81 |
| 6,254,273 | B1 * | 7/2001 | Galomb et al. | 383/63 |
| 6,296,388 | B1 * | 10/2001 | Galomb et al. | 383/63 |
| 6,347,885 | B1 * | 2/2002 | Buchman | 383/61.2 |
| 6,640,856 | B1 * | 11/2003 | Tucker | 383/2 |
| 2006/0193541 | A1 * | 8/2006 | Norcom | 383/2 |

* cited by examiner

*Primary Examiner*—Bryon P Gehman

(57) ABSTRACT

A product delivery system is device and method able to keep bag of product seal and delivering a bag product in easy and fast way. By tied up (using a fast locking strap) adjustable frame with seal cover to opened bag. Hang the bag on hook up side down (using a clip). By opening a little the caver (lid or zipper), product will drop down.

7 Claims, 7 Drawing Sheets

PRODUCT DELIVERY SYSTEM FOR FOODSTUFFS

CLAIM FOR PRIORITY

This application is a Continuation-In-Part of prior application Ser. No. 10/794,597 filed Mar. 8, 2004, now abandoned.

BACKGROUND OF THE INVENTION

1) Field of the Invention

The invention relates to packaged food product storage, preservation and dispensing.

2) Discussion of the Related Art

Storage of large bulk food items for animals has always been inconvenient, especially for those with limited space. Pet owners have little option, given the available products, to effectively use their limited space. Furthermore, for those with no space, find that outside storage is the only alternative. Because a majority of food buying is now in bulk, food storage can span from weeks to months, before it is depleted. The long length of time consistently exposes the food to oxygen, microbes, fungus, and in the case of outdoor storage, rain, wind, snow and sunlight.

The disadvantages of current pet food dispensers are that, many are too small to accommodate large bulk bags. They must then be refilled every few days of use. Those that have the space to store the bulk bags, generally lack the preservation means for the bag contents. Many simply crumble up the ends of the bag. This action does nothing to preserve the contents, exposing the food to oxygen, microbes and fungus. This situation becomes dire for those who are relegated to outdoor storage. There the bulk bag is also subject to extreme elements such as wind, sun, rain and snow.

DETAILED DESCRIPTION OF THE INVENTION

Figure 1:
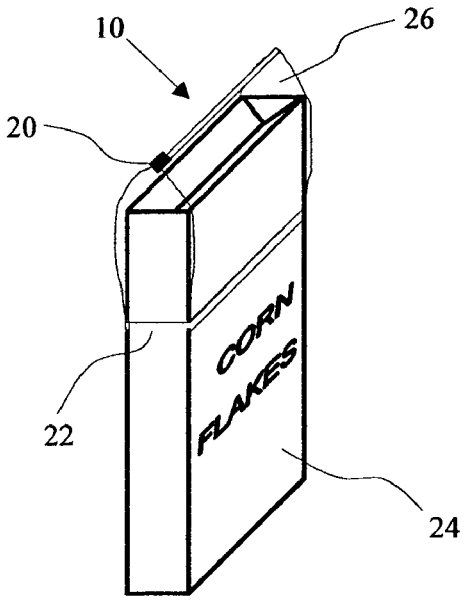
FIG. 1 is a perspective view of a Zipper Box Cover covering open box full of cornflakes.
Figure 2:
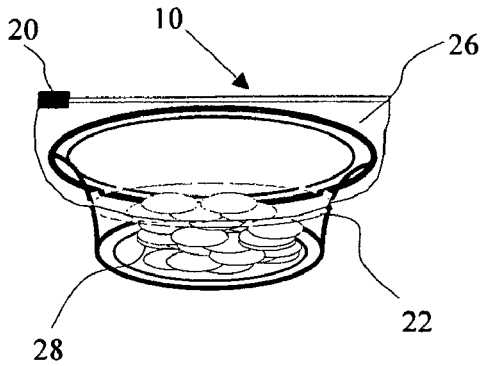
FIG. 2 is a perspective view of a Zipper Box Cover covering a plate with food ready to be eaten.
Figure 3:
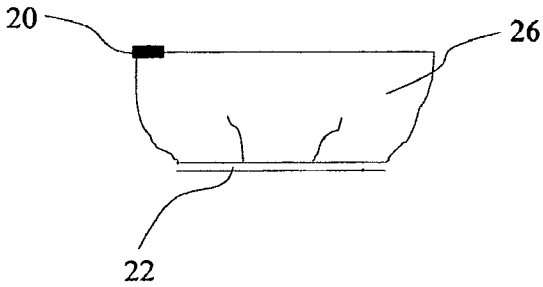
FIG. 3 is a side view that shows clearly the Zipper Box Cover.
Figure 4:
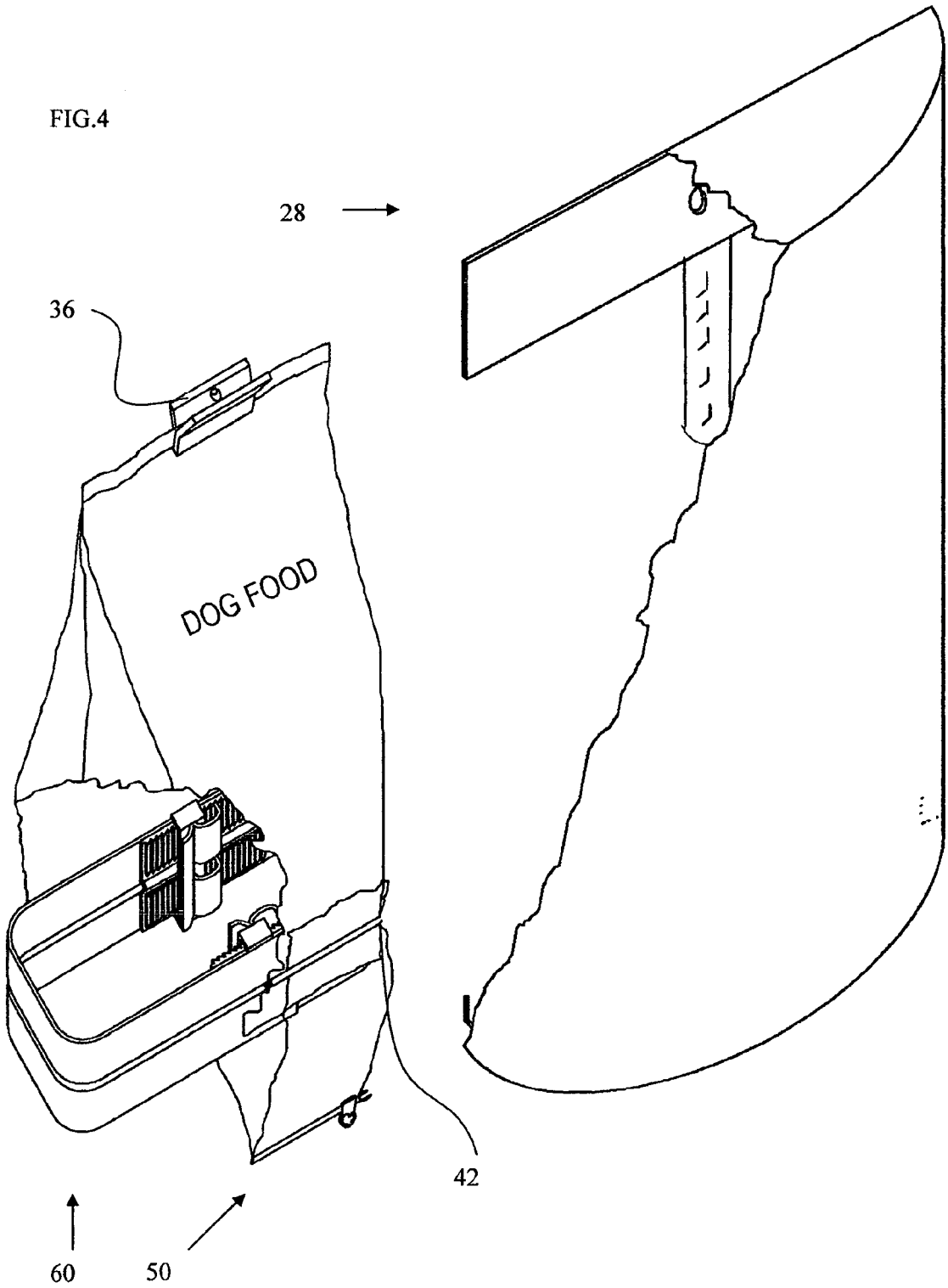
FIG. 4 is a perspective view of components of a product delivery system for foodstuffs.

FIG. 4 of the accompanying drawings illustrates a product delivery system according to an embodiment of the invention, which includes a protective cover 28, an eyelet clip 36, a securing strap 42, a zipper bag 50 and an adjustable body 60.

Figure 5:
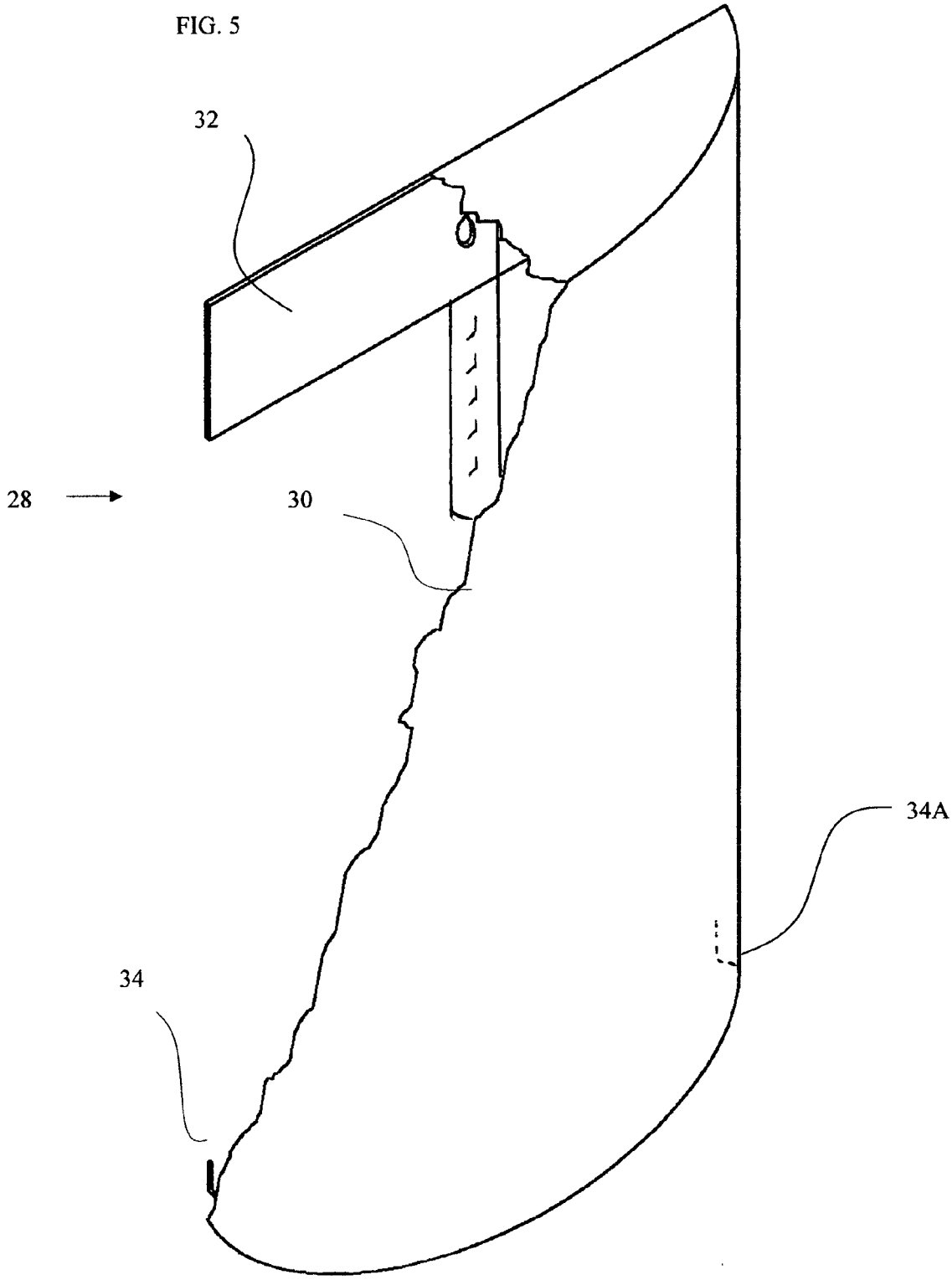
FIG. 5 is a section view.
Figure 6:
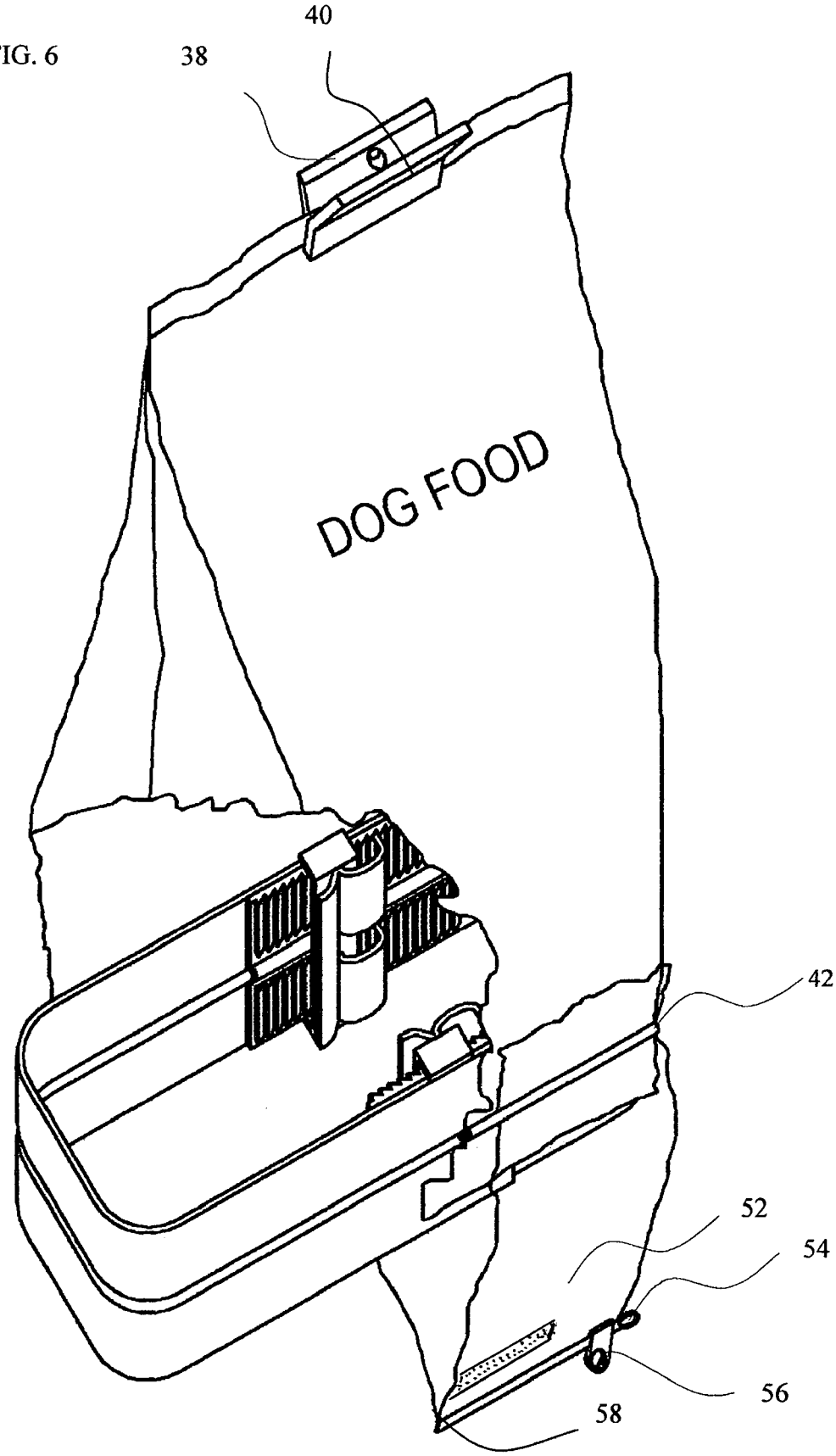
FIG. 6 is a perspective-view a securing strap, including, a handle and a locking mechanism.
Figure 7:
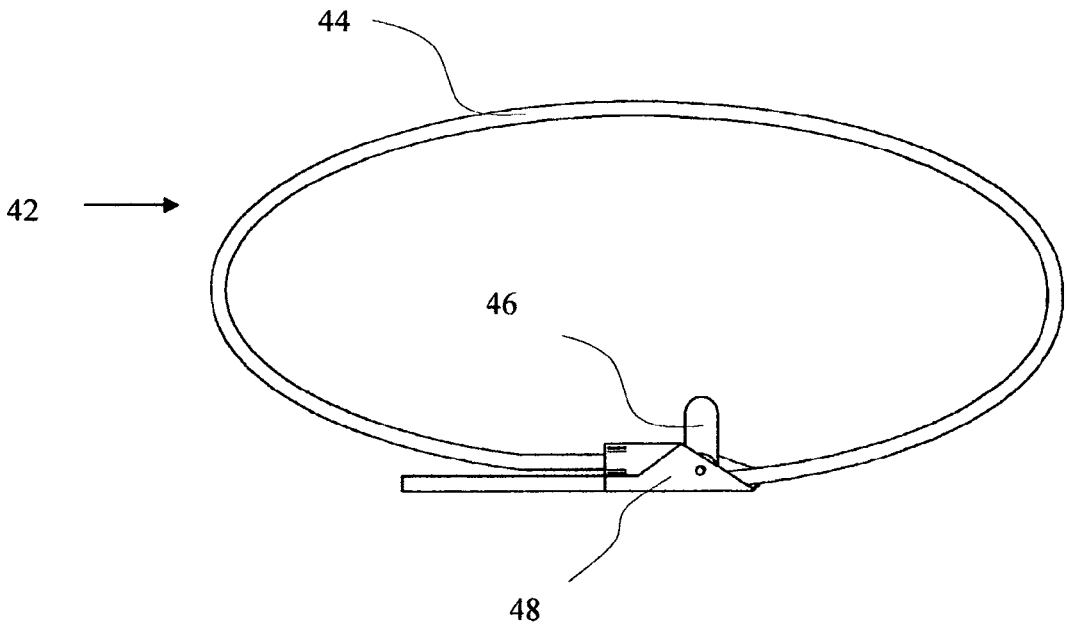
FIG. 7 is a view of a zipper bag and zipper eyelet

FIG. 5 of the accompanying drawings illustrates the protective cover 28 in more detail, including a shell 30, an interconnected eyelet member 32 and a first hook 34 and a second hook 34A. FIG. 6 of the accompanying drawings illustrates the eyelet clip 36 and the zipper bag 50 in more detail. The eyelet clip 36 includes a connected first parallel eyelet member 38 and a second parallel eyelet member 40. The zipper bag 50 includes a flexible clear body 52, a zipper 58, a first zipper eyelet 54, a second zipper eyelet 54A and a fastener 56. FIG. 7 of the accompanying drawings illustrates the securing strap 42 in more detail, including, a strap 44, a handle 46 and a locking mechanism 48.

Figure 8:
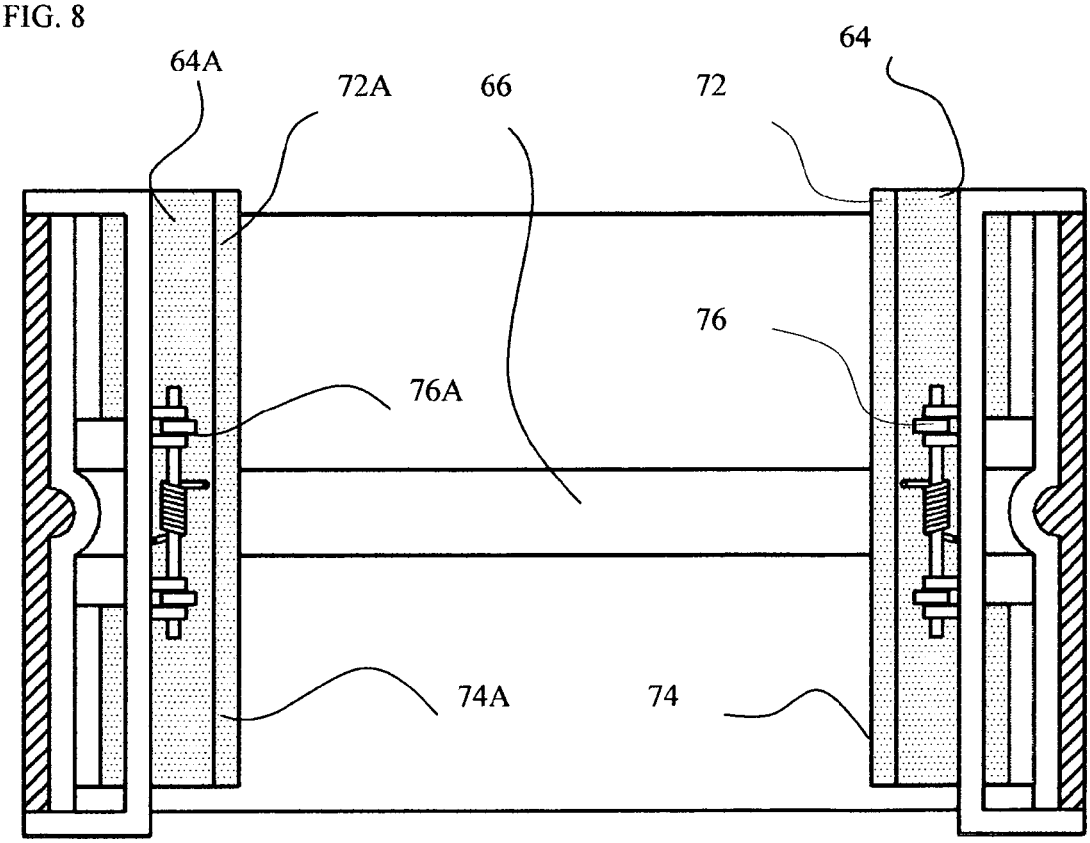
FIG. 8 is a cross-sectional view of an adjustable body, illustrating spring-loaded retainers of first and second retainer components and a securing recess.
Figure 9:
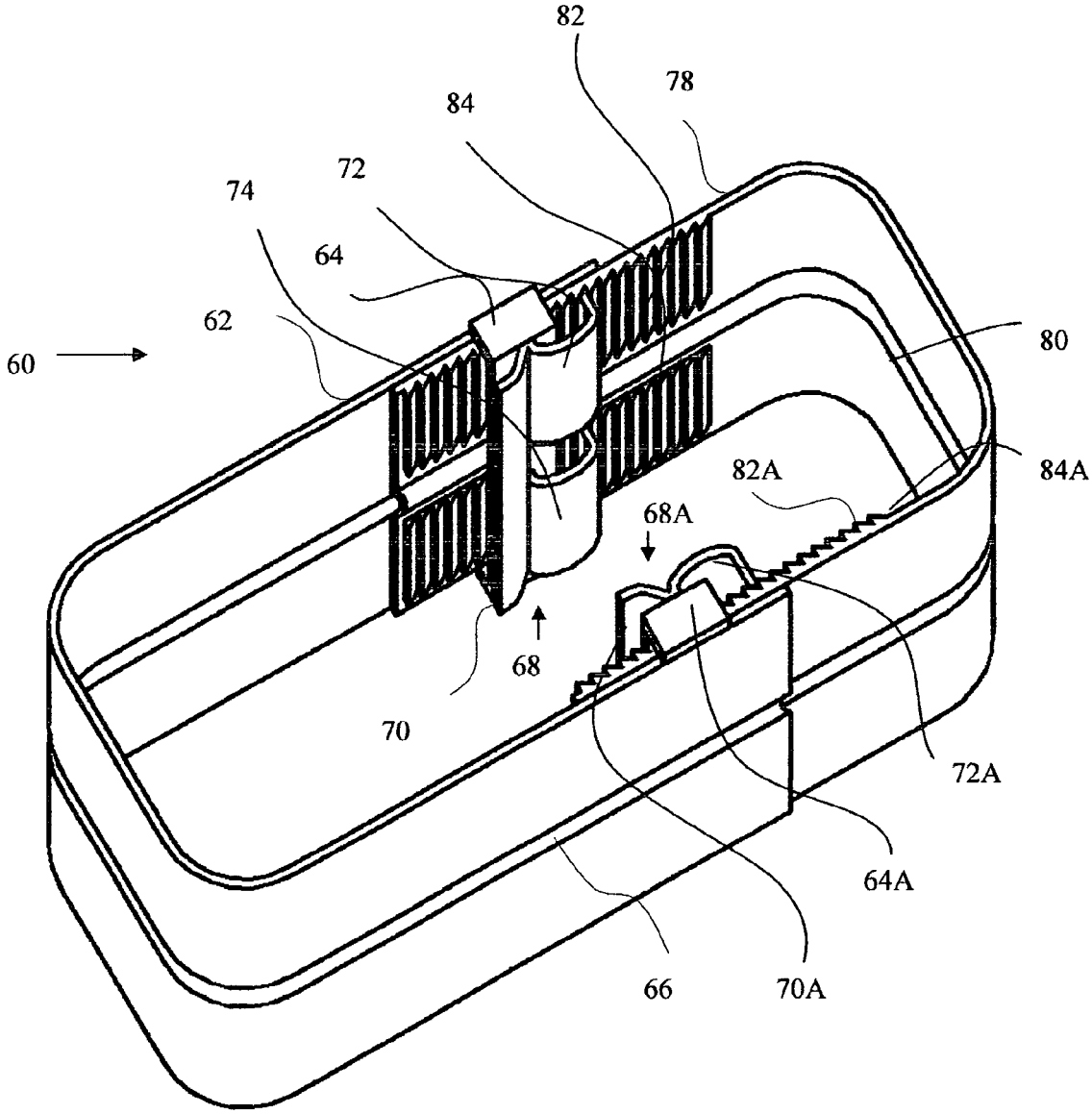
FIG. 9 is a perspective view of the adjustable body in detail, including the securing recess, the first and second retainer components, a first and a second housing and a first and a second, upper and lower plurality of sizing members.
Figure 10:
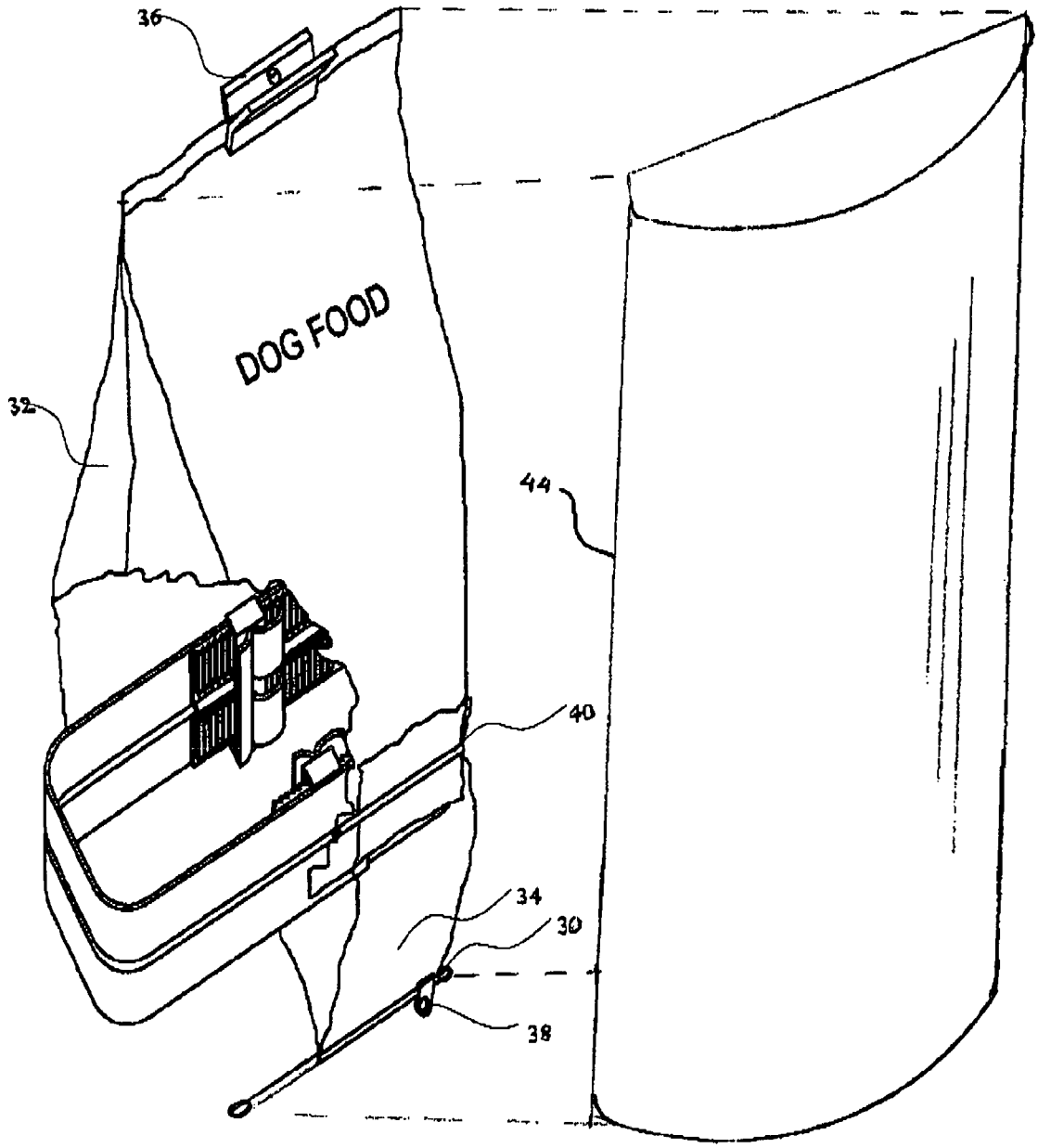
FIG. 10 is a perspective view of components of a product delivery system for foodstuffs, including the cover.

FIG. 8 illustrates of the accompanying drawings illustrates a cross-section of the first adjuster 62 of the adjusting body 60. FIG. 9 illustrates the adjustable body 60. The adjustable body is comprised of a first adjuster 62 and a second adjuster 78. The first adjuster is comprised of a first housing 64 and a second housing 64A, a first securing recess 66 and a first retainer component 68 and a second retainer component 68A. The retainer components are comprised of adjusting levers 70, and 70A, upper sizing clips 72 and 72A, lower sizing clips 74 and 74A, spring-loaded retainers 76 and 76A.

The second adjuster is comprised of a second securing recess 80, a first upper plurality of sizing members 82, a lower plurality of sizing members 84, a second upper plurality of sizing members 82A, a lower plurality of sizing members 84A.

In use, the product delivery system provides an effective means to store, preserve and dispense packaged food products. The eyelet clip 36 is connected to the packaged product by depressing said clip, disengaging the first and second parallel eyelet members 38 and 40, and then releasing said clip to connect with the product package The adjustable body 60 is then inserted into the open product package. The adjustable body 60 provides the initial stability and function by adjusting to the maximum diameter of a packaged food product. Upon insertion of the second adjuster 78 into the first housing 64 and second housing 64A of the first adjuster 62, the first and second upper 82 and 82A, and lower 84 and 84A, plurality of sizing members make contact with the upper sizing clips 72 and 72A and lower sizing clips 74 and 74A of the first retainer component 68 and second retainer component 68A.

The adjusting levers 70 and 70A are depressed, the upper 72 and 72A, and lower 74 and 74A, sizing clips disengage, and allow for further insertion of the second adjuster 78 to fit the diameter of the product package, once released, the spring-loaded retainers 76 and 76A spring forward, engaging the plurality of sizing members, resulting in a stable system and creating an open portion for dispensing the product.

Once the adjustable body is within the product package, the zipper bag 50 is placed over the opened portion of the product package, created by the adjustable body 60, enveloping the product package, thus placing a lining of the product package in between said adjustable body 60 and zipper bag 50. In one embodiment, the zipper bag can be adjustable to fit over any sized product package.

The securing strap 42 is placed around the zipper bag 50, the packaged product, and rests inside the connected first securing recess 66 and second securing recess 80 of the adjustable body 60. In one embodiment, the securing strap is elastic. The handle 46 is opened and strap 44 is then pulled, creating an airtight pocket over the open portion of the product package, allowing for maximum protection from oxidation, microbes and fungus. The locking mechanism 48 then aids in maintaining the security once the handle 46 is closed.

The interconnected eyelet member 32 of the protective cover 28 slides between the first and second parallel eyelet members 38 and 40 of the eyelet clip 36. The first and second hooks 34 and 34A of the protective cover 28 connect with the first and second zipper eyelet 54 and 54A in order to maintain the stability of the system. In one embodiment, said first hook 34 and second hook 34A, are adjustable, and can be connected to any size zipper bag 50 with respective zipper eyelets 54 and 54A. Upon vertical hanging, a hook, will pierce the first parallel eyelet member, the interconnected eyelet member 38 and the second parallel eyelet member 40, connecting and holding the product package, vertically, and within the protective cover 28.

The number of pet owners is consistently increasing. Many owners try and save money by buying food in bulk. Most often, pet owners find storage space limited due to the large quantity of food in bulk bags, and in some cases, they find that outside storage is the only option. Food bags can also be cumbersome and heavy to move around. Today, the quantities of pet food range from 6-50 lbs. The product delivery system provides for efficient use of limited storage space, preservation and ease of dispensing large bulk food items.

An advantage of the product delivery system is its vertical positioning. In an embodiment of the invention, a hook can hang the product delivery system vertically. The hook pierces the respective eyelets of, the first and second parallel eyelet members of the eyelet clip, as well as the interconnected eyelet member of the protective cover. This allows storage of a bulk-packaged product in a variety of areas that would ordinarily not be used. Moreover, because some owners are faced with limited space and must store food outdoors, the protective cover provides the necessary protection from the outdoor elements, effectively increasing the lifespan of the packaged product.

Another advantage of the product delivery system is its unique ability to preserve the contents of the bulk-packaged items. Using large quantities of food increases the amount of time spent exposed to the environment. Because animals eat such small portions the food containers can spend weeks, even months, exposed to oxygen, microbes and fungus. The product delivery system is equipped with a zipper bag that effectively reduces this exposure by employing very unique elements.

Paramount to these elements is the securing strap and recess. The securing strap is comprised of a strap, handle and locking mechanism. The strap can be effectively pulled to its maximum tension strength by use of the handle and locked into position by the locking mechanism. A securing recess, which is comprised of a first securing recess on the first adjuster and a second recess on the second adjuster, once connected, allows for the securing strap to rest within. This securing recess is another barrier to the introduction of oxygen into the packaged product, thus increasing its longevity.

The second element is the clear through plastic flexible cover. This cover is impermeable to the elements, providing safe storage of food for a prolonged period of time. As an added safeguard, the clear plastic allows an end user to primarily survey the contents of the bag, to ensure quality. Fungus is easy to spot and is indicative of contamination of the food source.

Generally, pet owners resort to using a cup or other utensil to reach in and pull out portions of food. An advantage of the product delivery system is its unique dispensing method. The zipper bag is comprised of a flexible clear body, a first and second zipper eyelet and a fastener. While the respective eyelets are connected to the protective cover hooks, the fastener can be moved with one hand, providing ease of dispensing product.

While certain exemplary embodiments have been described and shown in the accompanying drawings, it is to be understood that such embodiments are merely illustrative and not restrictive of the current invention, and that this invention is not restricted to the specific constructions and arrangements shown and described since modification may occur to those ordinarily skilled in the art.

What is claimed:

1. A product delivery system comprising: a protective cover, an eyelet clip, a securing strap, a zipper bag, and an adjustable body, the protective cover comprised of a first hook and a second hook, a shell and an interconnected eyelet member; the zipper bag comprised of a flexible body, a zipper with a first zipper eyelet, a second zipper eyelet and a fastener, the zipper bag covering a product package supported by the first and second hooks by connecting each said hook with a respective said zipper eyelet; the eyelet clip comprised of a first eyelet member and a second parallel eyelet member; the eyelet clip also connected to the product package and to the interconnected eyelet member via each said hook through a respective said zipper eyelet; the adjustable body comprising a first adjuster and a second adjuster, the first adjuster having a first housing, a second housing, a first securing recess, a first retainer component and a second retainer component, the retainer components are each comprised of an adjusting lever, an upper sizing clip, a lower sizing clip and a spring-loaded retainer, the second adjuster comprised of a second securing recess, a first upper sizing member and a second lower sizing member; the adjustable body adjusting the interior of the product package; the securing strap comprised of a strap, a handle and a locking mechanism, the securing strap, when tightened, securing the zipper bag to the product package and to the adjustable body by fitting within the securing recesses of the adjustable body, creating an airtight seal.

2. The product delivery system as in claim 1, wherein said securing strap is elastic.

3. The product delivery system as in claim 1, wherein said zipper eyelets are at the respective ends of the zipper.

4. The product delivery system as in claim 1, where in the zipper bag contains an adjustable band to help secure it to the adjustable body.

5. The product delivery system as in claim 1, wherein the zipper bag is any flexible or non flexible material that may mate with the adjustable body.

6. The zipper bag as in claim 5, wherein said securing strap creates an airtight pocket around a said zipper.

7. A method of delivering a food product employing the product delivery system of claim 1, the method comprising:

inserting the second adjuster into the first housing and the second housing of the first adjuster, the sizing members frictionally contacting with the sizing clips of the retainer components;

the adjusting levers are depressed, the sizing clips disengage and allow for further insertion of the second adjuster to fit the diameter of the product package; once released, the spring-loaded retainers spring forward, engaging the sizing members;

placing the zipper bag over the product package by the adjustable body enveloping the product package;

placing the securing strap over the zipper bag and the product package, the securing strap resting inside the first securing recess and the second securing recess of the adjustable body;

opening the handle of the securing strap;

pulling the securing strap and closing the handle and lock mechanism, creating an airtight pocket;

placing the interconnected eyelet member and the protective cover between the first and second parallel eyelet members of the eyelet clip;

contacting the first and second hooks of the protective cover with the first and second eyelets of the zipper bag; and a single hook piercing the first parallel eyelet member, the interconnected eyelet member and the second parallel eyelet member to connect and hold the product package vertically.

* * * * *